US005765639A

United States Patent [19]

Muth

[11] Patent Number: 5,765,639

[45] Date of Patent: Jun. 16, 1998

[54] TUBING PUMP SYSTEM FOR PUMPING WELL FLUIDS

[75] Inventor: Garold M. Muth, Bakersfield, Calif.

[73] Assignee: Muth Pump LLC, Bakersfield, Calif.

[21] Appl. No.: 692,820

[22] Filed: Jul. 29, 1996

Related U.S. Application Data

[63] Continuation-in-part of Ser. No. 325,971, Oct. 20, 1994, Pat. No. 5,505,258, and Ser. No. 610,630, Mar. 4, 1996, abandoned.

[51] Int. Cl.[6] ..... E21B 34/12; E21B 43/12; F04B 39/00

[52] U.S. Cl. ..... 166/72; 166/313; 166/117; 417/431

[58] Field of Search ..... 166/72, 313, 369, 166/117; 417/431, 432

[56] References Cited

U.S. PATENT DOCUMENTS

| | | | |
|---|---|---|---|
| 2,797,642 | 7/1957 | Bloudoff | 103/4 |
| 3,167,019 | 1/1965 | Harris | 103/4 |
| 3,765,483 | 10/1973 | Vencil | 166/265 |
| 3,771,603 | 11/1973 | Crowe | 166/314 |
| 3,802,802 | 4/1974 | Greer | 417/431 X |
| 4,056,335 | 11/1977 | Secrist | 417/431 |
| 4,646,839 | 3/1987 | Rickey | 166/335 |
| 4,880,062 | 11/1989 | Bland | 166/371 |

*Primary Examiner*—Terry Lee Melius
*Attorney, Agent, or Firm*—Townsend and Townsend and Crew LLP

[57] ABSTRACT

The invention provides apparatus for producing well fluids from an oil bearing formation penetrated by a well including a tubing string forming a production flow path for production fluids between the earth's surface and a location in the well suitable for receiving well production fluids, a power tubing parallel to the production tubing and connected to the flow path of the production tubing, a pump barrel formed in the power tubing, and a lubricating plunger in the pump barrel forming an annulus therewith and having ports to permit flow of lubricating fluids from the lubricating plunger into the annulus. The apparatus is provided with means for providing lubrication fluid to the lubricating plunger.

11 Claims, 4 Drawing Sheets

TUBING PUMP SYSTEM FOR PUMPING WELL FLUIDS

RELATED APPLICATIONS

This application is a continuation-in-part of U.S. application Ser. No. 08/325,971, filed Oct. 20, 1994, now U.S. Pat. No. 5,505,258; PCT/US95/13290, filed Oct. 19, 1995; and U.S. application Serial No. 08/610,630, filed Mar. 4, 1996 now abandoned. All of these applications are incorporated herein by reference for all purposes.

BACKGROUND OF THE INVENTION

1. Field of the Invention

The present invention is directed to a pumping system for producing well fluids from petroleum producing formations penetrated by a well. The present invention includes the use of dual parallel tubing strings having the lower portions connected by a crossover flow connection, one of the tubing strings, i.e., the production tubing string, forming a flow path for flowing production fluids to the surface and the other, i.e., the power tubing string, for providing a conduit for inserting, operating and removing a rod-activated pump plunger used to lift well fluids from the well and to move the well fluids up the well to the surface through the crossover flow connection. A flow control valve for controlling production flow is also provided. A lubricating plunger is provided to direct fluid from the annulus between the power tubing and the rods to an area between the barrel of the pump and the lubricating plunger to increase the efficiency of the pump and to assist in sand control.

2. Description of Related Art

Pumping well fluids from wells penetrating producing formations has been done for many years. This is particularly true where heavy viscous oil must be moved to the surface. Often heavy viscous oils such as produced from California formations which are relatively close to the earth's surface contain sand and are difficult to pump. Steam and diluents have often been used to lower the viscosity of heavy crudes to improve flow and pumping efficiency; however, sand is still a major problem.

Heretofore dual tubing strings for a pumping system for producing petroleum have been suggested. For example, pumping installations utilizing parallel dual tubing strings are disclosed in U.S. Pat. No. 4,056, 335 to Walter S. Secrest; U.S. Pat. No. 3,802,802 to F. Conrad Greer; and U.S. Pat. No. 3,167,019 to J. W. Harris.

There is still need, however, for a pumping system is having dual production and power tubing strings which permit ease of operation which has movable parts including the pump plunger which may be removed from the power tubing string and replaced in the tubing string without the need for removing the tubing strings from the well, leaving only the pump barrel and tubing in place.

BRIEF SUMMARY OF THE INVENTION

The present invention provides apparatus for producing well fluids from an oil bearing formation penetrated by a well including production tubing means forming a production flow path for production fluids between the earth's surface and a location in the well suitable for receiving well production fluids from a pump located in a parallel power tubing means. Flow control means are preferably located in the lower portion of the apparatus to permit flow of production fluids up the production flow path and to prevent flow of production fluids down the production flow path. Power tubing means extend down the well in parallel relationship with the production tubing means to a location in the well suitable for receiving production fluids into the lower portion of the power tubing means from said well. A tubing-type lubricating plunger is provided, and the plunger is preferably adapted to be inserted and removed from the power tubing means while the power tubing means are located in the well. Slots or perforations are provided to permit entry of well fluids from the producing formation into the lower portion of the power tubing means. A crossover flow path is formed between the lower portion of the power tubing means and the flow path of the production tubing means for flowing production fluids out of the power tubing means and into the flow path of the production tubing means as the only flow path for transfer of production fluids to the earth's surface. Rod means for operating the tubing-type pump are operatively connected to the pump. Preferably, the means for operating the pump includes a rod string extending down the power tubing means and operably connected to the plunger of the tubing-type pump. The operative elements of the tubing-type pump are preferably located in the well below the location of the flow control means. The pump barrel of the tubing-type pump is a lowest section of the power tubing string. A valve is provided for flowing lubricating fluid from the power tubing string into a hollow pull tube connecting the lower end of the rod string to a lubricating plunger of the pump. The lubricating plunger has flow ports for permitting flow of lubricating fluid from inside the plunger to the annulus between the outside of the plunger and the inside of the pump barrel. The plunger is used in the tubing pump to receive fluids from the pull tube to lubricate the pump, to improve its efficiency and to control sand from entering the area of between the plunger and barrel.

In a more specific aspect the present invention provides apparatus for pumping petroleum from a well penetrating a petroleum producing formation which includes a downhole assembly located in a well at a position adapted to receive petroleum fluids from the well. The downhole assembly includes a parallel anchor having a first passage and a second passage formed parallel to the central axis of the parallel anchor. Means are provided for mounting the parallel anchor in the well at the desired position and a tubular connecting pup is connected to the first passage of the parallel anchor and extends down the well. A flow control means such as a standing valve, or a sliding valve, which permits flow up the connecting pup tubing and prevents flow down the connecting pup tubing is connected in the lower portion of the apparatus, for example, in or near the connecting pup. A crossover flow head is connected between the lower end of the connecting pup tubing below the standing valve and an opening in the pump barrel to provide a flow path for petroleum from the pump barrel through the standing valve into the lower portion of the connecting pup tubing. A production tubing string extends from the earth's surface down the well and is inserted into the first passage of the parallel anchor to form, in combination with the crossover flow head, the connecting pup tubing and a tubular string, a flow path to the earth's surface for petroleum. A power tubing string is positioned in the well parallel to the production tubing string and extends through the second passage in the parallel anchor. Connecting means connect the lower end of the power tubing string to the upper end of the tubular landing nipple. A tubing-type seal off is inserted into the power tubing and landed in the tubular landing nipple. Means are provided to form a flow path for petroleum between the lower portion of the power tubing string and the lower portion of the production tubing string. Means are provided for disconnectably connecting the plunger of the tubing-type pump in operating position in the power tubing and the landing nipple for pumping fluid up the power tubing string to the flow path of the production tubing string. A lubricating plunger is provided for flowing lubricating fluid into the annulus formed between the pump barrel and a pump plunger.

The present invention provides an assembly which includes parallel power tubing and production tubing strings. A lubricating plunger is located inside and at the bottom of the power tubing string. The power tubing string connects to a bottom hole assembly with a crossover flow head which connects with the production tubing string. This provides for flow of production fluids from the pump to the production tubing string. A rod string, connected to a pumping unit at the surface gives the lubricating plunger of the tubing-type pump an up-and-down motion for pumping the well fluid to the surface through this production tubing string. A "Beard" valve is connected at the lower end of the rod string. The "Beard" valve includes a port to permit fluid flow from the power tubing annulus into the interior of the "Beard" valve. A hollow pull tube is connected to the lower end of the "Beard" valve and extends to and is connected to the lubricating plunger to provide for flow of lubricating fluids to the plunger. The plunger has ports for flowing the lubricating fluid out into the annulus between the plunger and the pump barrel. Thus, diluent or water with a surfactant may be placed in the power tubing for use in lubrication of the tubing pump to improve the efficiency thereof and to prevent sanding up of the pump.

The present invention utilized a tubing insert plunger. Thus, the plunger of the pump is connected to the rod string and is inserted inside the power tubing string. The lowermost section of the power tubing string forms the barrel of the pump. Generally, only the rod string has to be pulled to retrieve all moving and wearable pump parts except for the pump barrel. Thus, the apparatus of the present invention will save rig time when pump repairs or replacement is needed. Also because the production flow path is separated from the pumping rod string, the apparatus of the present invention will never have a floating rod problem. It will also eliminate inertia bars and require smaller less expensive rods. In addition, lubricating fluid may be injected down the power tubing string through the "Beard" valve and the hollow pull tube rod and into a lubricating plunger of the pump. The lubricating plunger is provided with ports to direct the fluid coming from the hollow pull tube into the area between the plunger and pump barrel. Increasing the pressure in the annulus of the power tubing to exceed that of the production tubing keep sand out of the area between the plunger and pump barrel and to increase pump efficiency.

OBJECT OF THE INVENTION

A principal object of the present invention is to provide a pumping system having parallel power tubing and production tubing strings in which production is flowed up the production tubing through a flow control valve connected at the lower end of the pumping system. A rod operated insertable and removable pump plunger is disconnectably connected into the power tubing wherein the pump plunger may be removed from and inserted into the power tubing without the need to remove the tubing string from the well. A hollow pull tube is connected to the lower end of the rod string by a "Beard" valve and used to operate the pump plunger and also to provide a source of lubricating fluid for the lubricating plunger of the pump. The plunger has ports for flowing the fluid into the area between the pump barrel formed by the lower end of the power tubing and the outside of the plunger with increased pressure in the pump annulus to inhibit sand production and to increase pump efficiency. The increased pressure is accomplished by appropriate surface mechanism such as a pump. Additional objects and advantages of the present invention will become apparent to those skilled in the art from the drawings which are made a part of this specification and the detailed description of the invention.

DETAILED DESCRIPTION OF THE INVENTION

Figure 1:
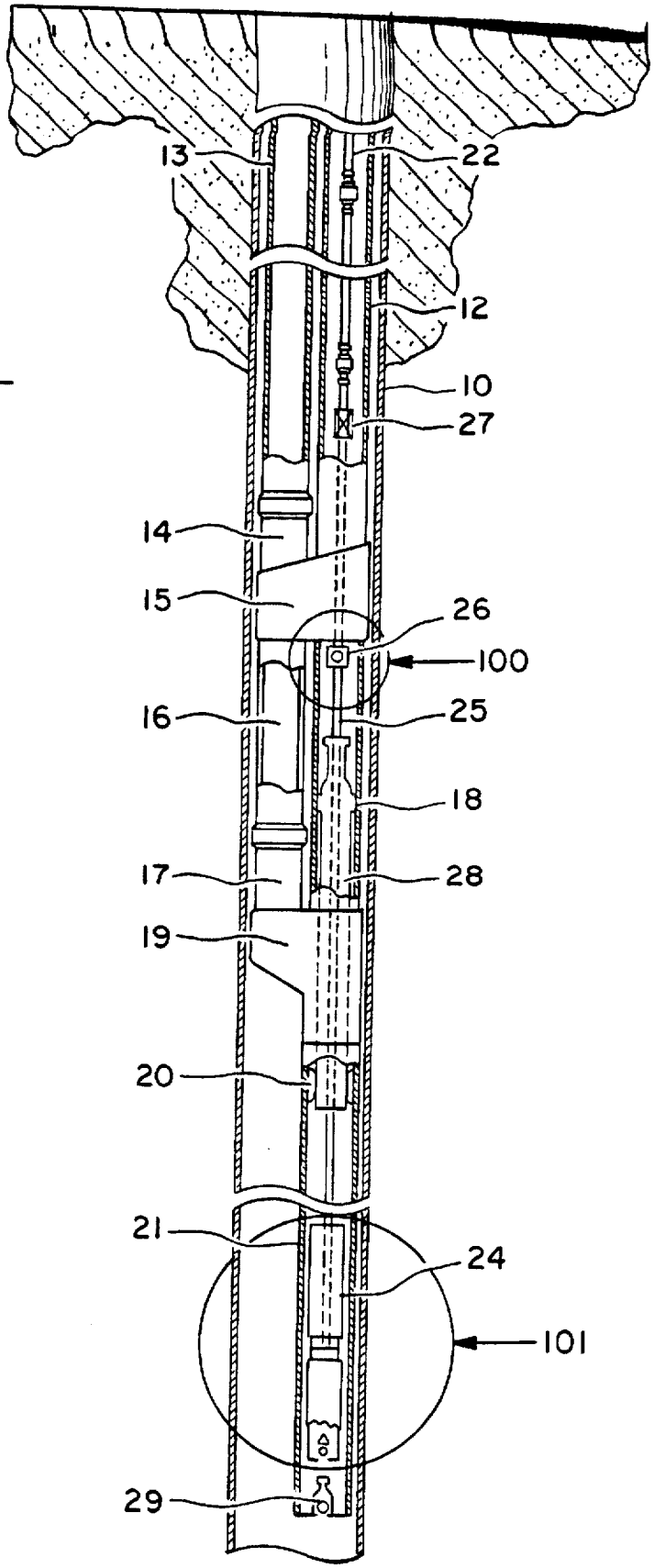
FIG. 1 is a diagrammatic vertical sectional view of a well equipped with a pumping system assembled in accordance with the present invention.

FIG. 1 shows an overall sectional view of a pumping assembly in accordance with the present invention. A casing 10 is operably positioned in the well. Parallel power tubing 12 and production tubing 13 strings are positioned in the casing and connect with the bottom hole assembly which houses a down hole tubing pump and insert plunger 24 having lubricating ports 80-83 (see FIGS. 4–5). The power tubing 12 and the production tubing 13 provide paths between the surface and a position in a well where well fluids are produced. As shown in FIG. 1, parallel anchor 15 has a first passage on the left and a second passage on the right of the anchor. A stab in tubing member 14 forming the bottom of the tubing string 13 extends through the first passage and is attached to the top of a connecting pup tubing 16 that screws into the top of a standing valve nipple 17. A crossover flow head 19 attaches to the bottom of the standing valve nipple 17 on the left side. The right side of the crossover flow head 19 is attached to the bottom of a lock shoe landing nipple 18 and the top of sealing nipple 20. The power tubing string 12 passes down through the second passage in parallel anchor 15 on the right side and screws into the top of the lock shoe landing nipple 18. Beneath the cross-over flow head 19 is a sealing nipple 20. A pump barrel 21, which is preferably the lowermost section of the power tubing string, is provided below the sealing nipple 20. When the production tubing string 13 is installed, the power tubing string 12 and the bottom hole assembly are already made up together and in place down hole in the well at a suitable location for recovering well fluids.

The production tubing string 13 has attached to the bottom of it a stinger 14 with seals which then stabs into the passage provided in the left side of the parallel anchor 15. At the surface the production string 13 is connected to a conventional flow line which carries well fluids off to a production tank. A tubing-type insert plunger 24 having lubricating ports 80–83 is adapted to be inserted and removed from the power tubing. The lubricating plunger 24 has a hollow pull tube 25 that is connected to a rod string 22. The hollow pull tube 25 is connected to the rod string 22 by means of a "Beard" valve 26. The rod string 22 protrudes upward through the inside of the power tubing string 12 to the surface and is then hung off the bridle and horses head of a conventional pumping unit. The pumping unit gives the plunger 24 its up and down motion to pump the well fluids to the surface. The down hole seal off 28 is also sealed inside of the top lock shoe landing nipple 18 which holds the body or outside of the seal off 28 in place and allows only the plunger 24 to reciprocate up and down in the pump barrel 21 to pump the well fluids. The nipple 17 provides a flow control means in the production tubing flow path. Flow control means, such as a traveling valve or a sliding sleeve, are fully described in my earlier application Ser. No. 08/325,971 and PCT/US95/13290, which have been incorporated by reference. A standing valve 29 at the lower end of the pump permits flow of well fluids into the lower portion of the pump barrel.

Referring again to FIG. 1 which shows the bottom hole assembly in more detail, the parallel anchor 15, with a stab in tubing member 14 having a sealing port for stabbing in, is attached to the top of the connecting pup 16 that screws into the top of the standing valve nipple 17. The cross-over flow head 19 attaches to the bottom of the standing valve nipple 17 on the left side. The right side of the cross-over flow head 19 is attached to the bottom lock shoe landing nipple 18 and the top sealing nipple 20. The power tubing string 12 then passes down through the parallel anchor 15 on the right side and screws into the top of the top lock shoe landing nipple 18. Beneath the cross-over flow head 19 is a sealing nipple 20 which screws into the top of the pump barrel 21. When the production tubing string 13 is installed, the power tubing string 12 and the bottom hole assembly are already made up together and in place down hole. The production tubing string 13 has attached to the bottom of it a stinger 14 with seals which then stabs into the left side of the parallel anchor 15.

Retrieving the bottom hole assembly from the well should never be necessary unless a hole develops in the power tubing string 12 from wear by the action of the rod string 22 or if there is sufficient wear of the pump barrel from the plunger 24. If this should happen, while the insert plunger is at the surface, simply pull the production tubing string 13, unsealing the stinger 14 with seals out of the parallel anchor 15. After this apparatus is at the surface, the bottom hole assembly may be pulled out with the power tubing string 12.

Figure 2:
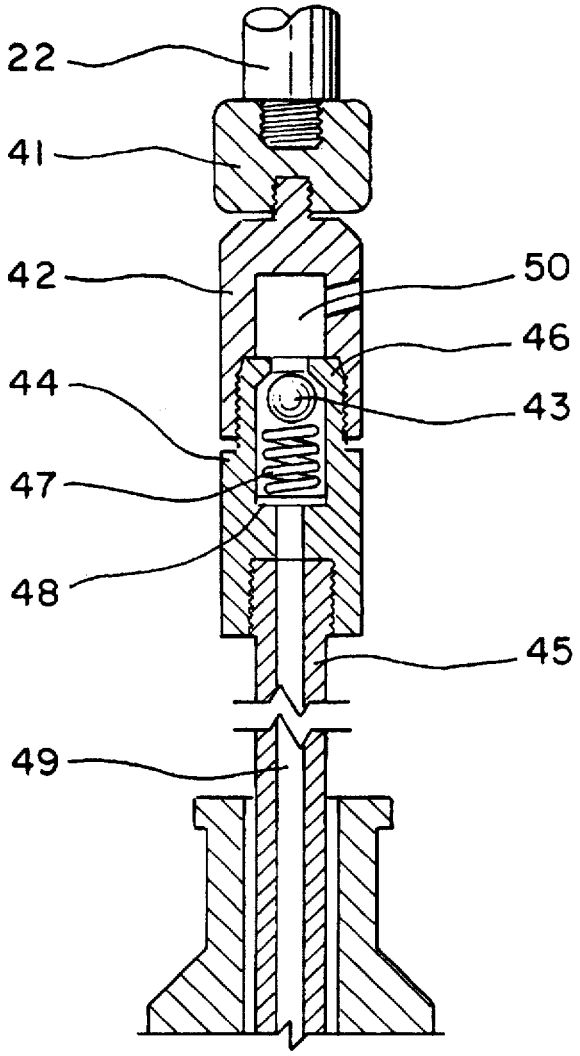
FIG. 2 is an enlarged vertical sectional view of the portion of the system of FIG. 1 indicated by 100 in FIG. 1.

FIG. 2 is an enlarged sectional view of "Beard" valve 26 shown in FIG. 1 in the circle indicated by the number 100. The valve 26 is connected to the rod string 22. The "Beard" valve comprises a caller 41 which is threadedly connected to an upper mandrel section 42 at its lower end. The mandrel section has a port 50 to permit flow of a lubricating fluid into the interior of the valve. A mating mandrel section 44 is threadedly connected to the upper mandrel section 42. A hollow pull tube 25 having an interior flow path 49 is connected to the lower mandrel 44 and to the top of the lubricating plunger 24. A check valve ball 43 and spring 47 which seats on seat 46 in mandrel section 44 and 42 permits flow of lubricating fluid downward through port 50 into pull tube 45 when pressure on the fluid in the power tubing is increased above the pressure in the pump barrel. The fluid flows to the lubricating plunger 24 inside of pump barrel 21.

Figure 3:
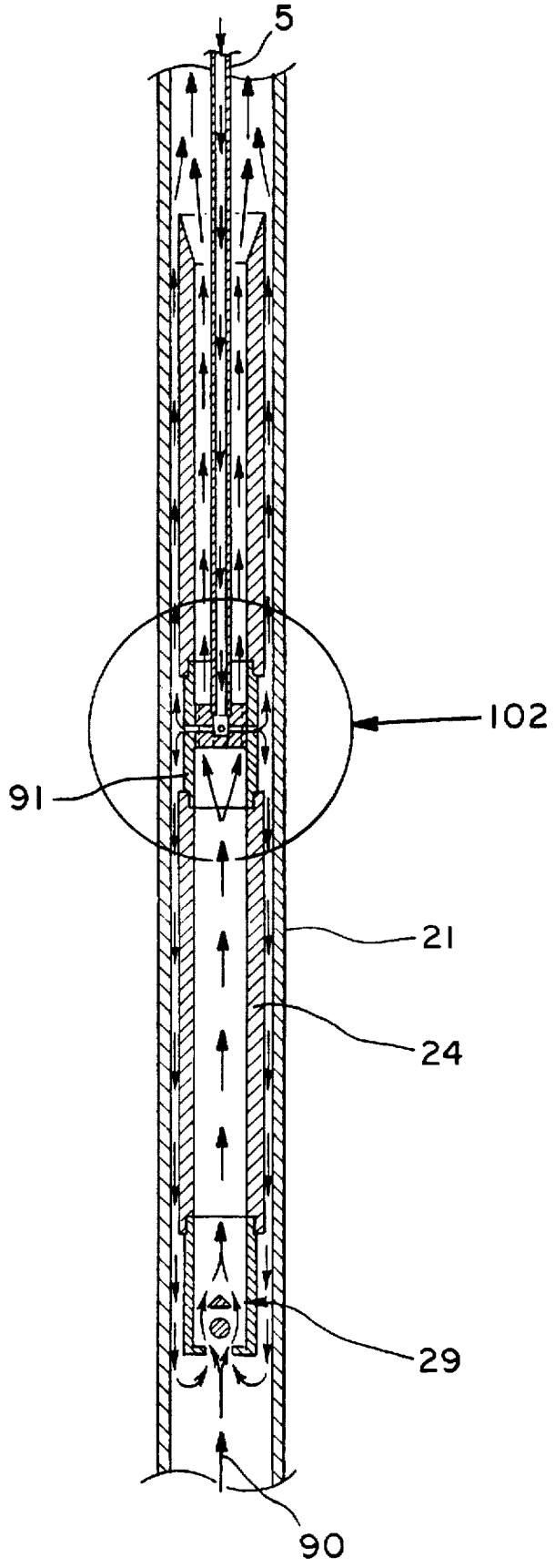
FIG. 3 is an enlarged vertical sectional view of the portion of the system of FIG. 1 indicated at 101 in FIG. 1.
Figure 4:
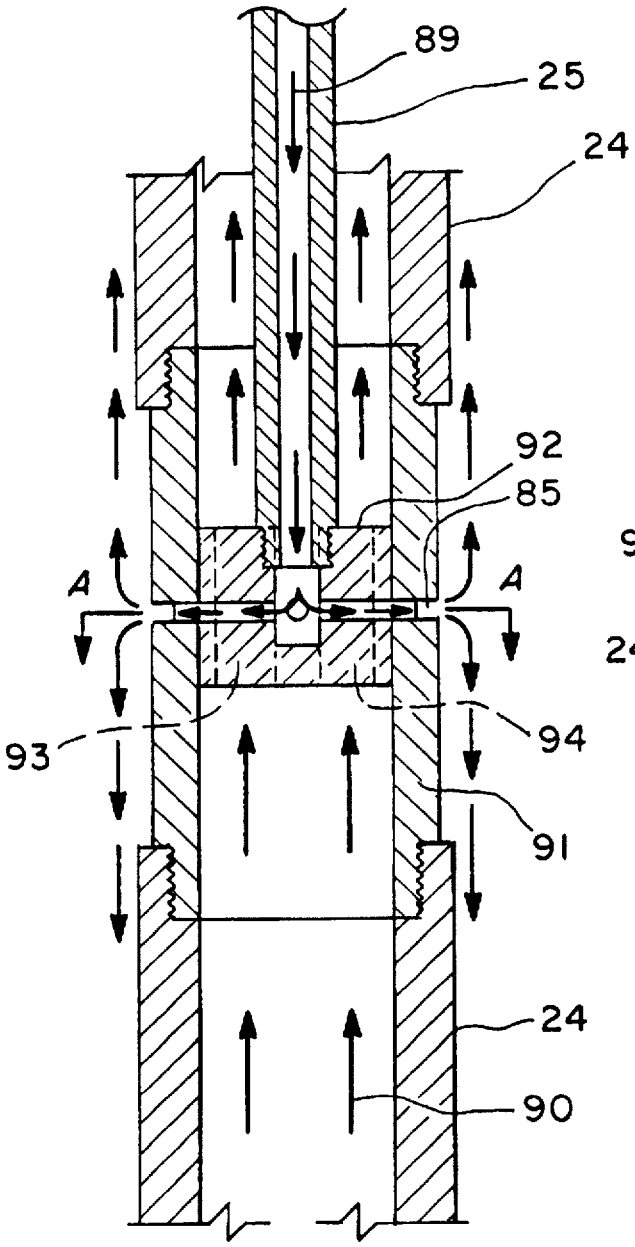
FIG. 4 is an enlarged vertical sectional view of the portion of the system of FIG. 3 indicated by 102 in FIG. 3.
Figure 5:
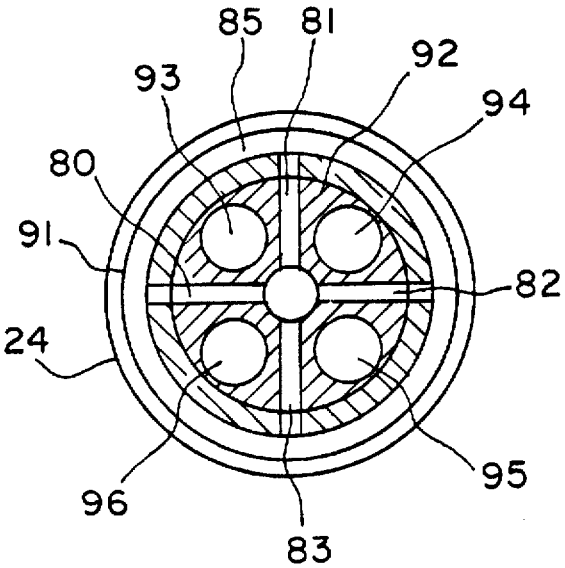
FIG. 5 is a sectional view take at A—A of FIG. 4.

Referring now to FIG. 3 which illustrates the lubricating plunger 24 and associated elements shown generally in the circle numbered 101 in FIG. 1. FIG. 3 is an enlarged vertical sectional view of the pump barrel 21 and the lubricating plunger 24. FIG. 4 is a more greatly enlarged vertical section of the mid-portion of the plunger 24 at the circle 102 of FIG. 3, and FIG. 5 is a sectional view taken at A—A of FIG. 4.

In FIG. 3 the lubricating plunger 24 is illustrated in the downstroke portion of the pump cycle. Arrows, indicated generally as 90, show the flow of well fluids through the traveling valve, ball, seat, and cage indicated generally as 29 up the interior of the plunger 24. As shown in FIG. 5, the well fluids pass through insert 92 in plunger connector 91 by means of ports 93–96. At the end of the downstroke and the beginning of the upstroke well fluids are raised up the production tubing as the traveling valve 29 closes.

Lubricating fluid 89 flows down hollow pull tube 25 to insert 92 in the plunger connector 91. The lubricating fluid then passes through ports 80, 81, 82, 83 into the area between pump barrel 21-plunger 24 annulus indicated by the number 85 in FIG. 5. This lubricating fluid lubricates the plunger and pump barrel in annulus 85 to help prevent sanding of the pump. The lubricating fluid comes from the power tubing through the "Beard" valve into the hollow pull tube. The lubricating fluid is injected by means of increasing the pressure on the fluid in the power tubing to a pressure higher than the pressure in the annulus 85 plus pressure drop in the "Beard" valve and hollow pull tube.

Thus, the present invention provides apparatus for producing well fluids from an oil bearing formation penetrated by a well including production tubing means forming a production flow path for production fluids between the earth's surface and a location in the well suitable for receiving well production fluids from a pump located in a parallel power tubing means. Flow control means are located in the lower portion of the apparatus to permit flow of production fluids up the production flow path and to prevent flow of production fluids down the production flow path. Power tubing means are extended down the well in parallel relationship with the production tubing means to a location in the well suitable for receiving production fluids into the lower portion of the power tubing means from said well. A tubing-type plunger is provided and is adapted to be inserted and removed from the power tubing means while the power tubing means are located in the well. Means are provided for entry of well fluids from the well into the lower portion of the power tubing means for pumping therefrom. A crossover flow path is formed between the lower portion of the power tubing means and the flow path of the production tubing means for flowing production fluids out of the power tubing means and into the flow path of the production tubing means as the only flow path for transfer of production fluids to the earth's surface. Rod means for operating the tubing-type pump are operatively connected to the pump. Preferably, the means for operating the pump includes a rod string extending down the power tubing means and operably connected to the plunger of the tubing-type pump. The operative elements of the insert type pump are preferably located in the well below the location of the flow control means. A valve is provided for flowing lubricating fluid from the power tubing string into a hollow pull tube connecting the lower end of the rod string to a lubricating plunger of the pump. The lubricating plunger has flow ports for permitting flow of lubricating fluid from inside the plunger to the annulus between the outside of the plunger and the inside of the pump barrel. The plunger is used in the tubing pump to receive fluids from the pull tube to lubricate the pump and to improve its efficiency and to control sand from entering the area of between the plunger and barrel.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. Variations and changes may be made by others without departing from the spirit of the present invention. Accordingly, all such variations and changes which fall within the spirit and scope of the present invention is defined in the following claims are expressly intended to be embraced thereby.

What is claimed is:

1. Apparatus for producing well fluids from an oil bearing formation penetrated by a well comprising:

a production tubing string forming a production flow path for production fluids between the earth's surface and a location in the well suitable for receiving well production fluids;

a power tubing string extending down said well in parallel relationship with said production tubing string to a location in said well suitable for receiving production fluids into a lower portion of said power tubing string from said well, said power tubing string having a pump barrel therein;

a pump plunger in said pump barrel of said power tubing string in a position for pumping well fluids from the well into the lower portion of said power tubing string; and a cross-over flow means vertically above the pump plunger and positioned between the lower portion of said power tubing string and the flow path of said production tubing string for flowing production fluids out of said power tubing string and into said flow path of said production tubing string for transfer to the earth's surface.

2. The apparatus of claim 1 further characterized by flow control means in said apparatus permitting flow of production fluids up said production flow path and preventing flow of production fluids down said production flow path.

3. The apparatus of claim 1, wherein said pump plunger is removable from said well without removing said pump barrel from said well.

4. The apparatus of claim 3, wherein at least a portion of said pump plunger is removable from said well without removing said pump barrel from said well.

5. Apparatus for producing well fluids from an oil bearing formation penetrated by a well comprising:

a production tubing string forming a production flow path for production fluids between the earth's surface and a location in the well suitable for receiving well production fluids;

flow control means in said apparatus permitting flow of production fluids up said production flow path and preventing flow of production fluids down said production flow path;

a power tubing string extending down said well in parallel relationship with said production tubing string to a location in said well suitable for receiving production fluids into a lower portion of said power tubing string from said well, said power tubing string including a pump barrel therein;

a lubricating plunger in said pump barrel of said power tubing string in a position for pumping well fluids from the well into the lower portion of said power tubing string; and a cross-over flow head vertically above the pump barrel and positioned between the lower portion of said power tubing string and the flow path of said production tubing string for flowing production fluids out of said power tubing string and into said flow path of said production tubing string for transfer to the earth's surface.

6. The apparatus of claim 5 further characterized by flow control means in said apparatus permitting flow of production fluids up said production flow path and preventing flow of production fluids down said production flow path.

7. The apparatus of claim 5 further characterized by an annulus between the lubricating plunger and the pump barrel and by ports in the lubricating plunger for flowing fluids from said plunger into said annulus.

8. The apparatus of claim 7 further characterized by a tubing string operatively connected to said lubricating plunger for providing lubricating fluid to said lubricating plunger.

9. The apparatus of claim 5, wherein said lubricating plunger is removable from said well without removing said pump barrel from said well.

10. The apparatus of claim 5, wherein at least a portion of said lubricating plunger is removable from said well without removing said pump barrel from said well.

11. Apparatus for producing well fluids from an oil bearing formation penetrated by a well comprising:

a production tubing string forming a production flow path for production fluids between the earth's surface and a location in the well suitable for receiving well production fluids;

a power tubing string extending down said well in parallel relationship with said production tubing string to a location in said well suitable for receiving production fluids into a lower portion of said power tubing string from said well, said lower portion of said power tubing string having a pump barrel;

a pump plunger in said pump barrel of said power tubing string in a position for pumping well fluids from the well into the lower portion of said power tubing string; and a cross-over flow head vertically above the pump barrel and pump plunger and positioned between the pump barrel and the flow path of said production tubing string for flowing production fluids out of said power tubing string and into said flow path of said production tubing string for transfer to the earth's surface.

* * * * *